US010704378B2

(12) United States Patent
Rogacheva et al.

(10) Patent No.: US 10,704,378 B2
(45) Date of Patent: Jul. 7, 2020

(54) WELL MONITORING

(71) Applicant: Expro North Sea Limited, Reading, Berkshire (GB)

(72) Inventors: Alexandra Vasil'evna Rogacheva, Southampton (GB); Robert Charles Bromwich, Blandford (GB); Bridget Mary Weston, Warminster (GB); Steven Martin Hudson, Sturminster Newton (GB)

(73) Assignee: Expro North Sea Limited, Dyce (GB)

( * ) Notice: Subject to any disclaimer, the term of this patent is extended or adjusted under 35 U.S.C. 154(b) by 0 days.

(21) Appl. No.: 15/159,241

(22) Filed: May 19, 2016

(65) Prior Publication Data

US 2016/0258278 A1 Sep. 8, 2016

Related U.S. Application Data

(63) Continuation of application No. 13/994,295, filed as application No. PCT/GB2011/001703 on Dec. 8, 2011, now Pat. No. 9,371,727.

(30) Foreign Application Priority Data

Dec. 14, 2010 (GB) ..... 1021230.6

(51) Int. Cl.
*E21B 47/04* (2012.01)
*E21B 47/12* (2012.01)

(52) U.S. Cl.
CPC ..... *E21B 47/042* (2013.01); *E21B 47/121* (2013.01); *E21B 47/122* (2013.01)

(58) Field of Classification Search
CPC ..... E21B 47/042; E21B 47/122; E21B 47/121
USPC ..... 324/324
See application file for complete search history.

(56) References Cited

U.S. PATENT DOCUMENTS 4,621,264 A * 11/1986 Yashiro ..... E21B 47/042 324/333
4,747,451 A * 5/1988 Adams, Jr. ..... E21B 47/042 166/105
5,642,051 A 6/1997 Babour et al.
5,926,024 A * 7/1999 Blount ..... G01V 3/30 324/324
6,046,724 A 4/2000 Hvass
6,165,336 A 12/2000 Maki et al.
(Continued)

FOREIGN PATENT DOCUMENTS

GB 2360849 A 10/2001
WO WO2003029615 4/2003
WO WO2003087882 10/2003

*Primary Examiner* — Christopher P McAndrew
*Assistant Examiner* — Zannatul Ferdous
(74) *Attorney, Agent, or Firm* — Getz Balich LLC

(57) ABSTRACT

Downhole water level detecting apparatus for detecting the level of water in a formation in the region of a well installation. The detecting apparatus includes a transmitter for applying electrical signals to a signaling loop at a first location. The signaling loop includes a downhole metallic structure of the well installation and an earth return. The detecting apparatus also includes a detector for monitoring electrical signals in the signaling loop, and an evaluation unit arranged for determining a level of water in the formation relative to the downhole metallic structure in dependence on the monitored signals.

17 Claims, 5 Drawing Sheets

(56) References Cited

U.S. PATENT DOCUMENTS

| | | | | |
|---|---|---|---|---|
| 6,464,008 | B1 * | 10/2002 | Roddy | E21B 33/14 166/154 |
| 6,469,635 | B1 * | 10/2002 | Hudson | E21B 47/122 175/40 |
| 7,768,413 | B2 | 8/2010 | Kosuge et al. | |
| 2002/0195247 | A1 * | 12/2002 | Ciglenec | E21B 7/06 166/250.11 |
| 2003/0041662 | A1 | 3/2003 | Milone | |
| 2004/0163806 | A1 * | 8/2004 | Hadley | E21B 47/042 166/250.03 |
| 2006/0220650 | A1 * | 10/2006 | Lovell | E21B 17/003 324/357 |
| 2007/0120704 | A1 * | 5/2007 | Hudson | G01V 11/002 340/854.9 |
| 2011/0139443 | A1 | 6/2011 | Chen | |

* cited by examiner

WELL MONITORING

This application is a continuation of U.S. patent application Ser. No. 13/994,295 filed Sep. 23, 2013, which is a 371 National Phase of PCT/GB2011/01703 filed Dec. 8, 2011 which claims priority from UK Patent Application No. 1021230.6 filed Dec. 14, 2010, the entire disclosures of which are incorporated herein by reference.

BACKGROUND OF THE INVENTION

1. Technical Field

This invention relates to well monitoring methods apparatus and arrangements.

2. Background Information

There are various pieces of information which it is desirable to have in relation to any given oil and/or gas well. One of these pieces of information is some indication of the level of water in the formation from which product (i.e. oil and/or gas) is being extracted. Typically, in a producing formation there will be a layer of product and below this a layer of water. This water may be naturally present or may be present as a result of it being used to drive the product out of the formation. It is desirable to know where this water level is in relation to the producing portion of the well. This can for example, allow appropriate action to be taken as the water approaches a level such that it would begin to be produced from the well.

SUMMARY OF THE INVENTION

The present invention is directed at providing methods, apparatus, and arrangements which may be used for detecting the level of water in a formation associated with a well.

According to one aspect of the present invention there is provided downhole water level detecting apparatus for detecting the level of water in a formation in the region of a well installation, the detecting apparatus comprising a transmitter for applying electrical signals to a signalling loop at a first location, which signalling loop comprises downhole metallic structure of the well installation and an earth return, a detector for monitoring electrical signals in the signalling loop, and an evaluation unit arranged for determining a level of water in the formation relative to the downhole metallic structure in dependence on the monitored signals.

In some embodiments, the detector may comprise a receiver for receiving signals from the signalling loop at a second location and the evaluation unit may be arranged for determining a level of water in the formation relative to the downhole metallic structure in dependence on the received signal strength.

In other embodiments the detector may be arranged to measure signals, for example current flowing, in the metallic structure between two spaced contacts. At least one of the two spaced contacts may be disposed at or in the region of the first location.

The first location may be downhole in the well installation. In some embodiments, this location may be close to the level at which water can be expected to be found.

In other embodiments the first location may be above a production packer.

The transmitter may be arranged to inject signals into tubing of the well installation. The transmitter may be arranged to inject signals into the tubing across an insulation joint provided in the tubing.

The transmitter may be arranged to inject signals into the tubing across a break in the tubing created by milling out a portion of the tubing whilst downhole.

In some embodiments, the apparatus may comprise a downhole tool of which the transmitter is a part and which is arranged to be disposed within the tubing.

The downhole tool may be moveable within the tubing. This can allow the tool to be located at a position chosen to maximise performance.

In other embodiments the transmitter may be located at the surface and/or powered from the surface. In such a case the signals to be applied to the metallic structure or the necessary power to generate such signals may be conducted downhole via a cable to the first location.

The receiver may be arranged to extract signals from tubing of the well installation. The receiver may be arranged to extract signals from the tubing across an insulation joint provided in the tubing.

The second location may be in the region of the surface of the well. In an alternative both the first and second locations may be downhole.

The apparatus may comprise a relay station comprising the receiver and an additional transmitter for transmitting signals relating to a level of water in the formation towards the surface. Said signals may be indicative of signal strength detected at the receiver. Said signals may be indicative of a determined water level. The relay station may comprise the evaluation unit.

The apparatus may comprise at least one further relay station comprising an additional receiver for receiving signals from a respective previous relay station and another additional transmitter for onward transmission of signals.

The, each, or at least one of the relay stations may comprise a downhole tool, which is arranged to be disposed within the tubing and which may be moveable relative to the tubing.

The, each, or at least one of the relay stations may be arranged to transmit and receive across an insulation joint.

According to another aspect of the present invention there is provided a downhole water level detecting arrangement comprising a detecting apparatus as defined above installed in a well installation in relation to which a water level is to be determined.

The well installation may have tubing extending further into the formation than is required for product (oil and/or gas) extraction. This can aid in the detection of the water level as changes in received signal strength with water level are greater when the tubing extends into the part of the formation below the water level. An extended tubing can also help improve signalling range up towards the surface.

The well tubing may comprise a non-perforated section below a perforated section.

The well tubing may be provided with at least one circumferential band of ceramic insulation around its inner and/or outer surface. Preferably a plurality of axially spaced bands are provided. Preferably the band or bands are provided on a non-perforated section of tubing below a perforated section. The provision of such bands can aid in the detection of the water level as it rises to and past each band.

According to a further aspect of the present invention there is provided a method for detecting the level of water in a formation in the region of a well installation, comprising the steps of: applying an electrical signal to a signalling loop at a first location, which signalling loop comprises downhole metallic structure of the well installation and an earth return; monitoring electrical signals in the signalling loop; and determining a level of water in the formation relative to the downhole metallic structure in dependence on the monitored signals.

The step of monitoring signals may comprise the step of receiving an electrical signal from the signalling loop at a second location; and the step of determining a level of water in the formation may be carried out in dependence on received signal strength.

The method may comprise the step of ensuring that tubing is provided in the well installation to a depth beyond that required for extraction of product. This may include ensuring that the tubing extends at least to a depth which corresponds to a maximum desirable water level. The maximum desirable water level may vary with time and the depth to which the tubing extends may, in some circumstances, be varied within the life of the well in response to the maximum desirable water level.

The method may be carried out in a well installation having any or all of the features defined above.

BRIEF DESCRIPTION OF THE DRAWINGS

Embodiments of the present invention will now be described, by way of example only, with reference to the accompanying drawings in which.

DETAILED DESCRIPTION OF THE INVENTION

Figure 1:
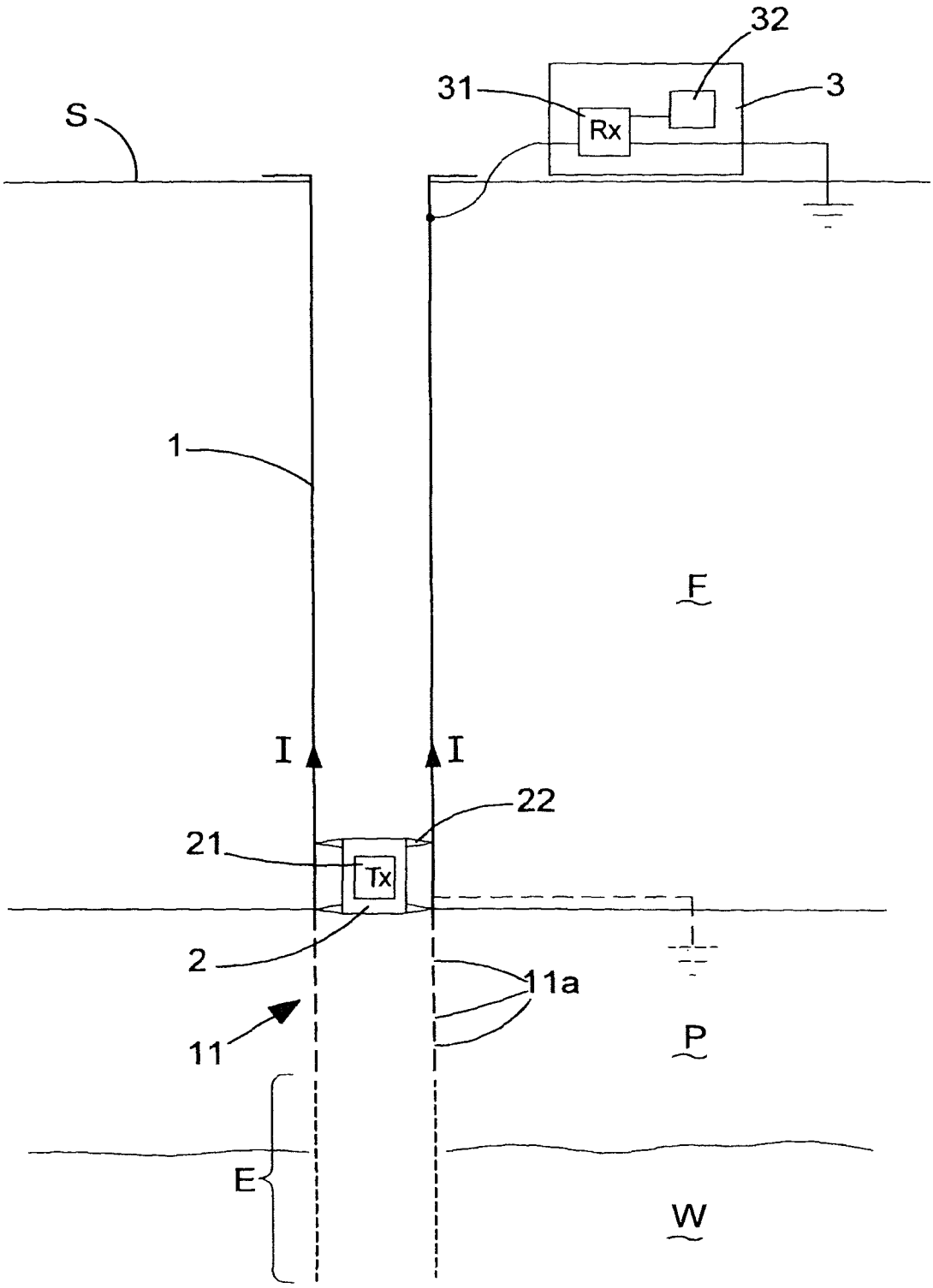
FIG. 1 schematically shows a downhole water level detecting arrangement.

FIG. 1 shows a downhole water level detecting arrangement comprising water level detecting apparatus installed in a well installation.

The well installation comprises production tubing 1, extending from the surface S down through the formation F to a producing region P where product (i.e. oil/gas) exists within the formation. In the producing region P the production tubing 1 has a perforated section 11 with perforations 11*a* to allow the product to flow into the production tubing 1 and towards the surface. Below the producing region P there exists water W within the formation. Typically the tubing 1 will not extend down into this water bearing region of the formation during the typical operation of a producing well.

However, in some implementations, to give enhanced performance in the water level detecting arrangement to which this specification relates, the production tubing 1 may be provided with an extension portion E which extends beyond the perforated section 11 further than would normally be the case. Where the production tubing 1 extends in such a way, the extension portion E would be provided without perforations and can extend into the water bearing part W of the formation at least as the water level rises towards the perforated section 11 of the production tubing 1.

There would normally be no reason to have the production tubing 1 extending any significant distance beyond the perforated section 11, but in the present techniques such an extension portion E can be of use as will become clearer following a more detailed explanation of the present techniques below.

In the present water level detecting arrangement, the detecting apparatus comprises a downhole tool 2 which is disposed within the production tubing 1 at a region close to the perforated section 11 of the production tubing 1 and a surface unit 3 located in the region of the well head.

The downhole tool 2 is arranged for injecting electrical signals into the metallic tubing 1 at the downhole location. These signals are extremely low frequency alternating current signals having a high current. In a typical implementation the frequency of the signals may be in the order of 0.1 Hertz and the applied current may be in the region of 70 Amps.

The downhole tool 2 comprises a transmitter 21 and conductive centralisers 22 which are arranged to mechanically and electrically contact with the production tubing 1 to allow signals from the transmitter 21 to be fed into the production tubing 1. Of course, the downhole tool 2 may comprise other components such as a receiver, sensors, and so on, but these are not of particular pertinence to the present invention.

Once signals have been applied to the metallic structure 1, a signal I propagates away from the tool 2 towards the surface S. Considering the position in the other direction, ie, downwards from the tool 2, then in effect there is a distributed connection to Earth via the metallic structure of the tubing 1 residing in the formation. The strength of the signal I propagated towards the surface is influenced by how good this distributed connection to Earth is. That is to say it is influenced by the impedance seen between the downhole tool 2 and Earth.

The present techniques use this fact in the detection of the level of water within the formation because the level of water within the formation influences the impedance between the tool 2 and Earth and thus influences the magnitude of the signal I which propagates towards the surface along the production tubing 1.

The surface unit 3 comprises a receiver 31 which is connected between the production tubing 1 in the region of the well head and Earth for extracting the signal I from the tubing 1. The signal strength seen by this receiver 31 varies as the impedance of the signalling loop changes and in particular as the impedance to Earth from the tool 2 changes. Thus, the received signal strength at the receiver 31 varies as the water level within the formation changes. The surface unit 3 comprises an evaluation unit 32 which is calibrated and arranged for giving an indication of the water level relative to the metallic structure 1 of the well in dependence on the signal strength received at the receiver 31.

As mentioned above, the production tubing 1 may be provided with an extension portion E which extends further beyond the perforated section 11, i.e. producing region of the production tubing 1, than would normally be the case. This is useful in the present techniques as the degree of change in signal strength that will be seen at the receiver 31 changes much more rapidly as the water level progresses up through the formation in a region where the metallic production tubing 1 is present than when it is progressing up through the formation at a level below which the production tubing stops.

An extension portion E can assist in signalling range towards the surface.

Figure 2:
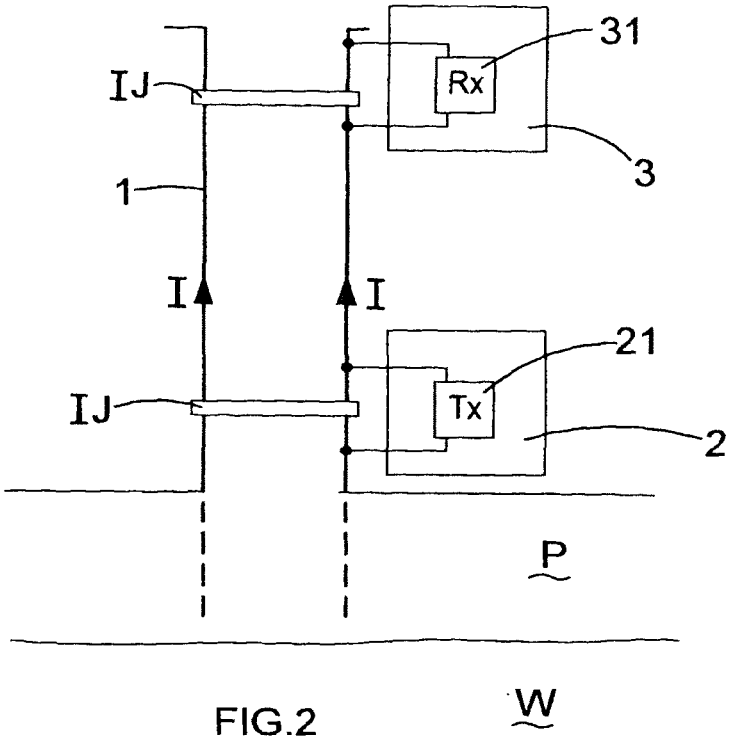
FIG. 2 schematically shows a downhole water level detecting arrangement which is similar to that shown in FIG. 1 but in which use is made of insulation joints in the tubing.

FIG. 2 schematically shows a downhole water level detecting arrangement which is similar to that shown in FIG. 1. In this case insulation joints IJ are provided in the production tubing 1 at the region of the downhole tool 2 and the surface unit 3. As such the transmitter 21 of the downhole tool can be connected across an insulation joint as can the receiver 31 of the surface unit 3. It will be appreciated that an insulation joint is provided to electrically insulate one portion of tubing from another.

The principles of operation of such an arrangement are the same as that described above with relation to FIG. 1, but the provision of insulation joints IJ in the production tubing 1 where this is feasible, can provide a convenient way of enhancing the performance of the system particularly the provision of a downhole insulation joint IJ at the downhole tool 2.

Of course the provision of an insulation joint IJ is only possible where such a joint is included in the tubing 1 during completion or recompletion of a well. Furthermore, the inclusion of such a physical insulation joint between sections of the metallic tubing is not always possible or desirable.

The arrangement shown in FIG. 1 is more suitable for retro-fitting operations as the downhole tool 2 in that arrangement can be deployed within the tubing 1 in an already completed well. Further it can be used where the inclusion of an insulation joint IJ is not feasible.

In non-retro fit situations it may be possible to provide a tool which is external to the production tubing 1. Such a situation is schematically illustrated in the arrangement shown in FIG. 2. However, of course, a internally disposed downhole tool 2 of the type shown in FIG. 1 may also be used, where insulation joints IJ are provided.

As a further alternative in some situations it will be possible to mill away tubing in the intended region of the downhole tool (whilst the tubing is in situ in an existing well). This can create a partial or complete break in the tubing which can be signalled across in the same way as an insulation joint. This of course increases the options of retro-fitted systems.

Figure 3:
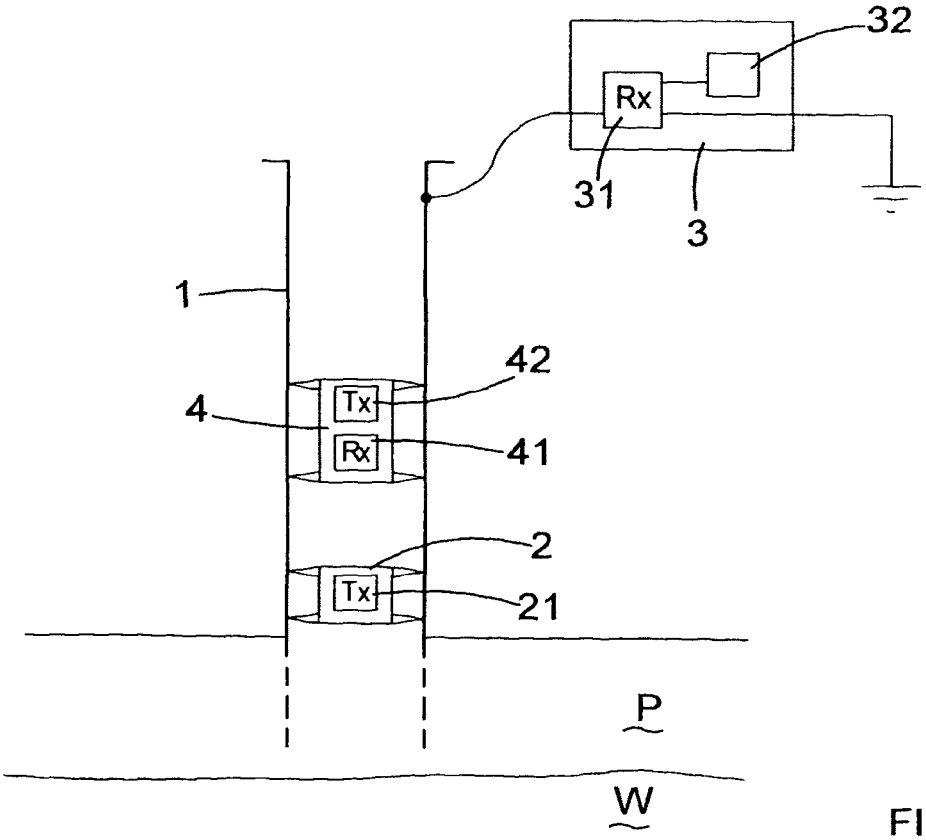
FIG. 3 schematically shows a downhole water lever detecting arrangement which is similar to that shown in FIGS. 1 and 2 but in which a relay station is included.

FIG. 3 schematically shows a further downhole water level detecting arrangement which is similar to that shown in FIG. 1 and described above. Here, however, as well as the downhole tool 2 located close to the perforated section 11 of the production tubing 1, there is provided a downhole relay station 4 having a receiver 41 for receiving the signals transmitted by the downhole tool 2 and a transmitter 42 for transmitting signals onwards up to the surface unit 3.

The provision of a relay station 4 downhole can help improve the sensitivity of the system whilst giving the desired range. Where a downhole tool 2 of the present type is located close to the end of the production tubing 1 as is desirable in the present case, its range for upward transmission is smaller than when the tool 2 is spaced further from the end of the production tubing 1. On the other hand, placing the tool 2 close to the end of the production tubing 1 helps in giving good sensitivity for detecting the water level in the formation. Thus, the provision of a relay station 4 helps provide an improved system. In the present arrangement the relay station 4 is arranged for receiving the signal transmitted by the transmitter 21 of the downhole tool 2 and then transmitting, using the transmitter 42, a signal which is indicative of the received signal strength as seen by the receiver 41. This signal which is indicative of the received signal strength at the receiver 41 of the relay station is then received by the surface unit 3 and used by the evaluating unit 32 to provide an indication of the water level.

In an alternative implementation the evaluation unit may be provided in the relay station 4 such that a determination of the water level is made in the relay station 4 and a signal which is representative of this water level is transmitted by the relay station 4 onwards towards the surface unit 3.

Figure 4:
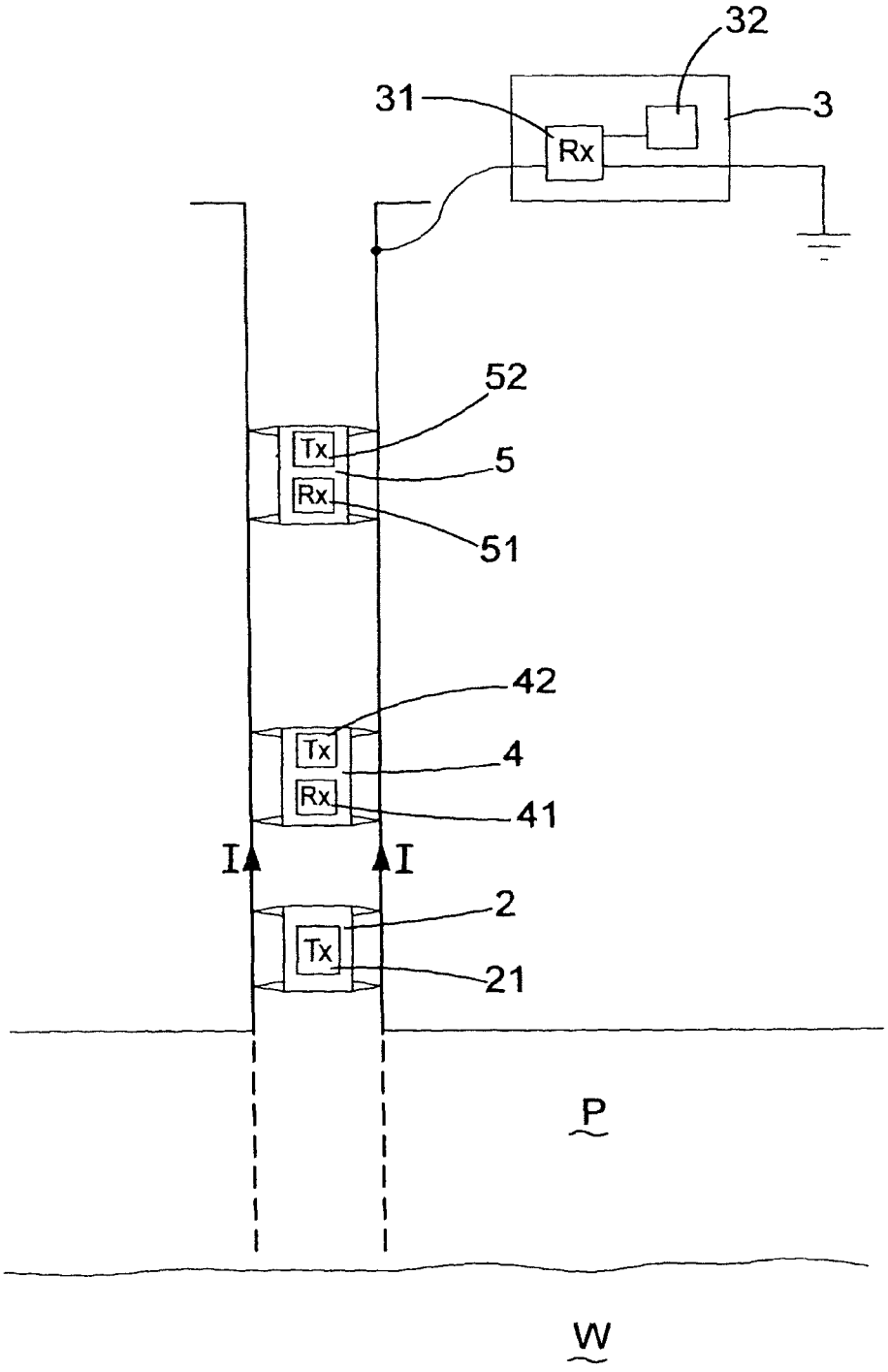
FIG. 4 shows a further alternative downhole water level detecting arrangement similar to those shown in FIGS. 1 to 3 but in this instance including two relay stations.

FIG. 4 shows yet another alternative downhole water level detecting arrangement which is similar to that shown in FIG. 3 and described above. Here, however, two relay stations 4 and 5 are included each with a receiver, 41, 51 and transmitter 42, 52. The functioning and operation of each relay station 4,5 is the same as described above in relation to the relay station 4 of FIG. 3, but the provision of two relay stations allows one of these to be disposed close to the downhole tool 2 to further increase the sensitivity of the detection system whilst still allowing an extended range to the surface.

It will, of course, be appreciated that which of the arrangements is chosen between those shown in FIGS. 1 to 4 will depend on the circumstances in a particular well installation ie for example, most obviously dependent on the depth of the well. Clearly, the provision of more downhole tools as relay stations will tend to give the best performance, but this has to be weighed against the cost involved and the obstructions that these cause in the flow line.

Of course, in principle there is no reason why the number of relay stations needs to be limited to two and a choice may be made as to where the water level determination is made, ie whether this is in one of the relay stations or at the surface.

Figure 5:
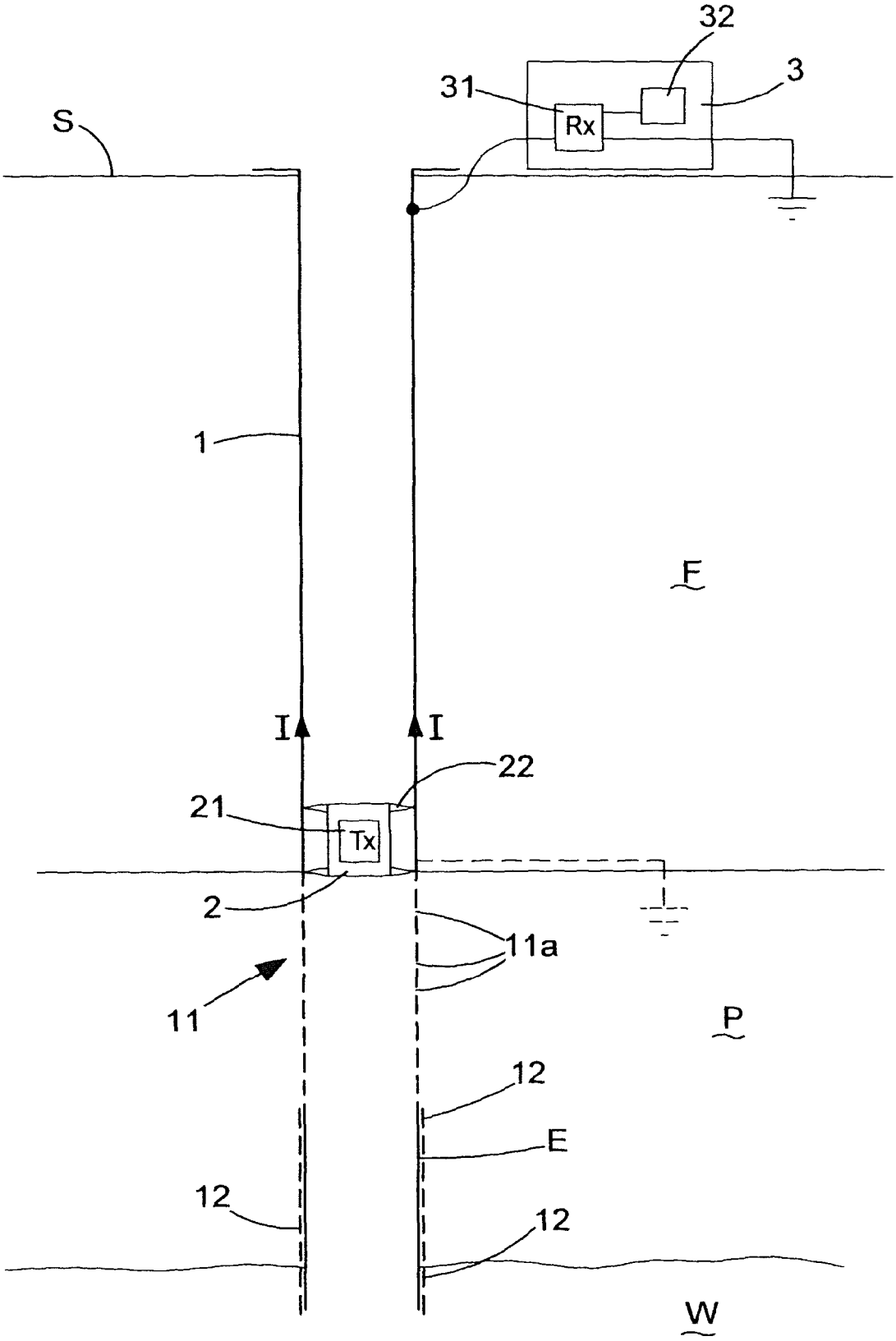
FIG. 5 schematically shows a further downhole water level detecting arrangement which is similar to that shown in FIG. 1 but which includes a modified form of well tubing.

FIG. 5 shows a further alternative downhole water level detecting arrangement which in this case is similar to that shown in FIG. 1. In fact the water level detecting apparatus installed in the well installation of FIG. 5 is the same as that installed in the well installation of FIG. 1. However the structure of the well installation itself is different. In this instance an extension portion E is provided to the production tubing. This extension portion E is a solid walled portion of tubing which extends further down into the well than the perforated portion 11. This extension portion E of the production tubing 1 has provided around its external surface a series of axial spaced insulating portions 12. In the present embodiment each of these insulating portions comprise an insulating ceramic coating. These insulating bands 12, change the impedance characteristics of the tubing in terms of conduction to earth. This in turn leads to a modification of the change in signals which will be received at the receiving unit 3 as the water level progresses up the tubing.

Figure 6:
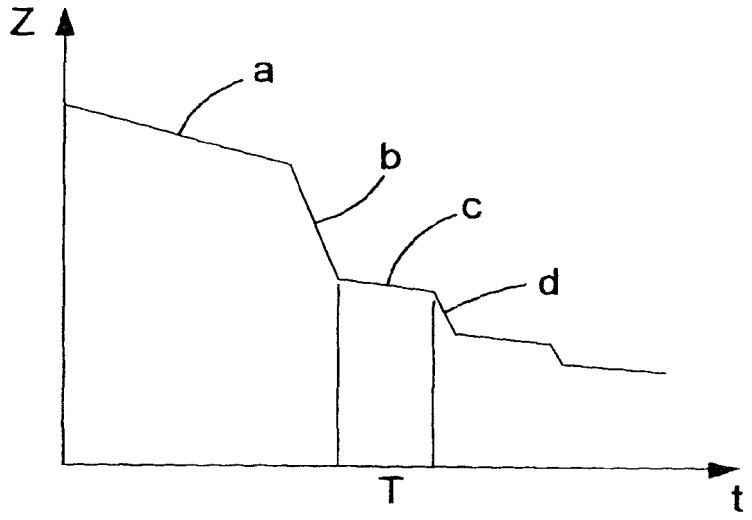
FIG. 6 shows a schematic plot of impedance against time which may be seen in a downhole water level detecting arrangement of the type shown in FIG. 5 as water rises within the well.

FIG. 6 schematically shows a plot of impedance Z seen between the downhole tool 2 and earth against time t as the water level rises within the well. As the water level approaches the end of the tubing, the impedance will be steadily decreasing as shown by portion a of the plot. However as the water reaches the bottom of the metallic tubing the impedance will begin to much more rapidly decrease as the water progresses up the tubing and more and more of the tubing is immersed in water—this is shown by portion b of the plot. However, when the water reaches an insulated portion 12 of the tubing there will be a slower decrease in impedance as the insulated portion of the tubing does not offer such a good direct conduction path between the water and the tubing. This is shown as part c of the plot. Once the first band of insulation material 12 is passed (corresponding to the position of the water level shown in FIG. 5), the impedance will begin to drop more rapidly again as the water rises, illustrated by another portion of the plot labelled d. There will then be a slower decrease as the next band is reached.

These statements of course rely on the fact that the water level is rising at a steady rate. However, whether or not this is true, what is true is that a difference in behaviour will be seen as each insulation band is traversed which gives an indication of the water level. Further, a time period which traversing each band 12 takes, indicated as T in the plot of FIG. 6, will give a measure of the speed at which the water level is rising. The point to make here is that it should generally be easier to spot (say computationally determine) a change in behaviour as one of the bands of insulation is passed, than it is to directly determine the water level or the rate of change of water level directly from the received signal strength itself.

Whilst this idea of providing insulating bands of material 12 on an extension portion E of the production tubing 1 has been described here in relation to the water level detecting arrangement of FIG. 1, it will be appreciated that this technique is equally applicable to the other water level detecting arrangements described in the present specification.

Figure 7:
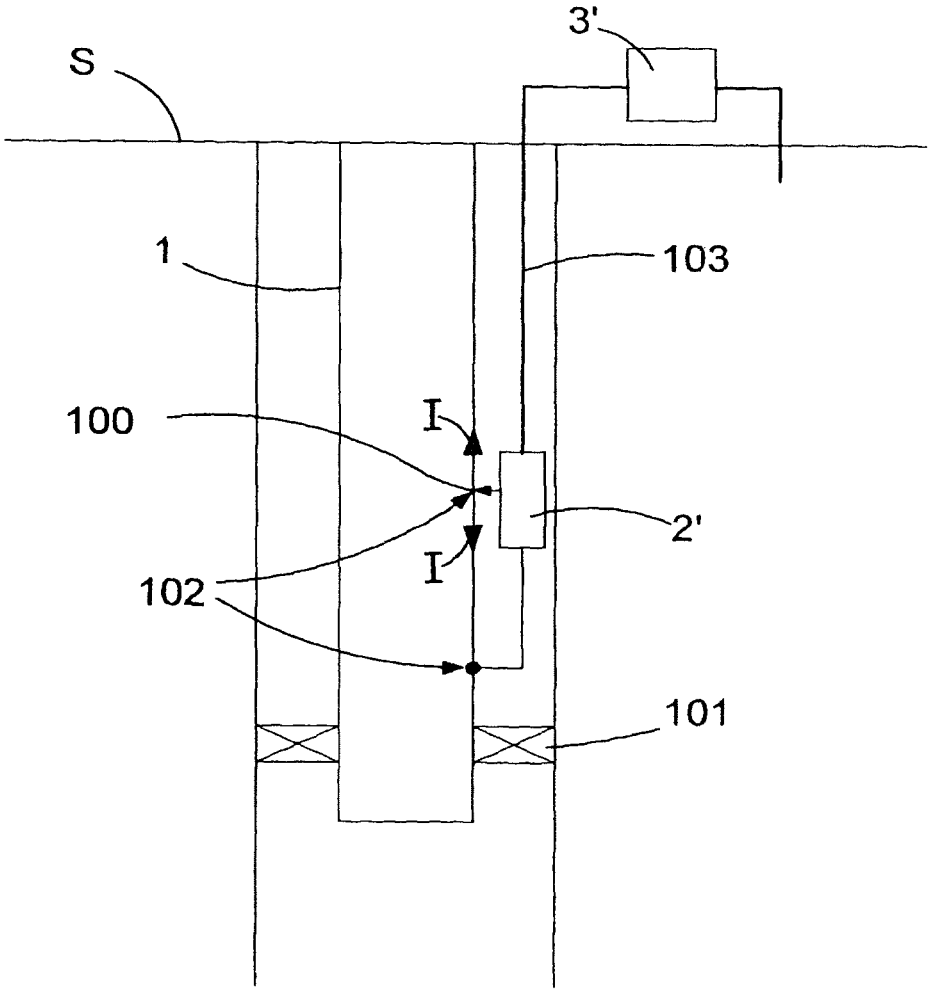
FIG. 7 shows a further alternative downhole water level detecting arrangement.

FIG. 7 shows a further alternative downhole water detecting arrangement which operates on a slightly different basis than those described above.

The downhole water level detecting arrangement again comprises water level detecting apparatus installed in a well insulation. Again there is production tubing 1 within the well and signals I are applied to this tubing which in turn is connected to earth by virtue of progressing through the formation and production region as in the arrangements described above. Furthermore, this arrangement relies on the fact that the characteristics of the signal path including the production tubing 1 and the formation F will be influenced by the level of water in the formation. In the present arrangement however, power for applying a signal I to the production tubing is provided from the surface S.

The water level detecting apparatus of the present embodiment comprises a modified downhole tool 2' and a modified surface unit 3'. The downhole tool 2' is arranged for injecting the signal I at an injection point 100 into the production string 1 and is arranged to be disposed above a packer 101 in a producing well. The modified downhole tool 2' comprises spaced contacts 102 for contacting with the production tubing 1 and is connected via a cable (for example a tubing encapsulated cable—TEC) 103 to the surface unit 3'.

The modified downhole tool 2' is arranged for detecting the current I injected into the string and in particular flowing in a portion of conductor—ie the tubing 1—disposed between the locations at which the spaced contacts 102 are located. In the present embodiment the level of current flowing between these two contacts 102 will be dependent on the impedance between the injection point 100 and earth as via the distributed earth provided by the production tubing. Hence this current level will be dependent on the water level.

Because downhole tool 2' is connected via the electrical cable 103 to the surface unit 3', the surface unit 3' may supply power to the downhole tool 2 which is then used to generate the signal for injection at the injection point 100. Alternatively, the cable 103 may be used to conduct the signal to be injected directly from the surface unit 3' to the injection point 100.

Furthermore, readings taken at the downhole tool 2' based on the signals detected by the spaced contacts 101, may be transmitted back to the surface unit 3' via the cable 103.

The water level detecting arrangement of FIG. 7 has the advantage that it is powered from the surface such that a larger number of readings may be taken and/or the system may be operated over a longer time than the systems which make use of a downhole power source, particularly where such a downhole power source would be batteries.

Typically the modified downhole tool 2' would be arranged for sending back readings along the cable 103 to the surface unit 3' for processing in order to determine the current water level. In alternatives however, processing can take place at the downhole tool 2' and a processed signal (such as a signal indicative of the current water level) can be passed back via the cable 103 to the surface unit 3'. In order to improve performance of the system of this embodiment, the tubing portion in the region of, and between, the two spaced contacts 102 may be of a corrosion resistant alloy.

This again, is a technique which is more suited for use in a new completion than as a retro-fit option.

A benefit of this system is that it avoids having to install components deep into the well where this can cause issues by restricting flow.

The invention claimed is:

1. A well installation for detecting a downhole location level of a water bearing region (W) in a formation associated with a well, the well installation comprising:

tubing comprising a product extraction section and an extension portion, the extension portion disposed at a depth in the well beyond the product extraction section, and the extension portion is configured to provide a distributed connection to Earth;

a transmitter configured to apply signals to the tubing;

an evaluation unit; and a receiver configured to receive said signals from the tubing, said signals having a strength, and to communicate the received signals to the evaluation unit;

wherein the extension portion is configured such that an impedance experienced by the signals conducted within the extension portion varies as a function of the downhole location level of the water bearing region (W), and the strength of the signals received by the receiver varies as a function of the impedance experienced by the signals conducted within the extension portion; and wherein the evaluation unit is configured to detect the downhole location level of the water bearing region (W) based on the strength of the signals received by the receiver.

2. The well installation according to claim 1, wherein the extension portion extends at least to a depth that corresponds to a maximum desired downhole location level of the water bearing region (W).

3. The well installation according to claim 1, wherein the extension portion comprises a non-perforated section below a perforated section of tubing.

4. The well installation according to claim 1, wherein the extension portion has impedance characteristics and an outer surface, and wherein the extension portion includes at least one insulation portion disposed around the outer surface, which insulation portion is configured to change the impedance characteristics of the extension portion in terms of conduction to Earth.

5. The well installation according to claim 4, wherein the extension portion comprises a plurality of bands of insulating portions disposed around the outer surface and axially spaced apart from one another.

6. The well installation according to claim 5, wherein the plurality of axially spaced bands of insulating portions comprise an insulating ceramic coating.

7. The well installation according to claim 1, wherein the tubing comprises production tubing.

8. A method for detecting a downhole location level of a water bearing region (W) in a formation associated with a well, comprising:

providing a well installation comprising tubing having a product extraction section and an extension portion, the extension portion being disposed at a depth within the well beyond the product extraction section, and the extension portion is configured to provide a distributed connection to Earth;

applying signals to the tubing and receiving the applied signals from the tubing;

wherein the extension portion is configured such that an impedance experienced by the applied signals conducted within the extension portion varies as a function of the downhole location level of the water bearing region (W), and a strength of the received signals varies as a function of the impedance experienced by the applied signals conducted within the extension portion; and detecting the downhole location level of the water bearing region (W) in the formation associated with the well based on the strength of the received signals.

9. The method of claim 8, wherein the extension portion extends at least to a depth that corresponds to a maximum desired downhole location level of the water boundary bearing region (W).

10. The method of claim 8, wherein the extension portion comprises a non-perforated section below a perforated section of tubing.

11. The method according to claim 8, wherein the extension portion having impedance characteristics and an outer surface, and the extension portion includes at least one insulation portion disposed around the outer surface, and the insulation portion is configured to change the impedance characteristics of the extension portion in terms of conduction to Earth.

12. The method according to claim 11, wherein the extension portion comprises a plurality of bands of insulating portions disposed around the outer surface and axially spaced apart from one another.

13. The method according to claim 12, wherein the plurality of axially spaced bands of insulating portions comprise an insulating ceramic coating.

14. The method according to claim 8, wherein the well installation includes a well head; and wherein the receiving the applied signals from the tubing includes receiving the signals at a receiver of a surface unit, that surface unit being connected between the tubing in a region of the well head and Earth.

15. The method according to claim 8, wherein the tubing is production tubing.

16. A surface unit for detecting a downhole location level of a water bearing region (W) in a formation associated with a well, which well includes a well head and tubing extending downhole from the well head, the tubing comprising a product extraction section and an extension portion, the extension portion disposed at a depth in the well beyond the product extraction section, and the extension portion is configured to provide a distributed connection to Earth, the surface unit comprising:

an evaluation unit; and a receiver configured to receive signals from applied to the tubing and communicate the received signals to the evaluation unit, wherein an impedance experienced by the applied signals conducted within the extension portion varies as a function of the downhole location level of the water bearing region (W), and a strength of the received signals varies as a function of the impedance experienced by the applied signals conducted within the extension portion;

wherein the evaluation unit is configured to detect the downhole location level of the water bearing region (W) in the formation based on the strength of the received signals.

17. The surface unit according to claim 16, wherein the surface unit is connected between the tubing in a region of the well head and Earth.

* * * * *